US009656407B2

(12) United States Patent
Kronen

(10) Patent No.: US 9,656,407 B2
(45) Date of Patent: May 23, 2017

(54) ARTICLE AND METHOD FOR SPREADING A SUBSTANCE ABOUT A SURFACE

(76) Inventor: George V. Kronen, Storrs, CT (US)

( * ) Notice: Subject to any disclaimer, the term of this patent is extended or adjusted under 35 U.S.C. 154(b) by 1372 days.

(21) Appl. No.: 13/349,156

(22) Filed: Jan. 12, 2012

(65) Prior Publication Data

US 2012/0181208 A1 Jul. 19, 2012

Related U.S. Application Data

(60) Provisional application No. 61/432,618, filed on Jan. 14, 2011.

(51) Int. Cl.
*B05B 1/30* (2006.01)
*B28B 1/20* (2006.01)

(52) U.S. Cl.
CPC ..... *B28B 1/20* (2013.01)

(58) Field of Classification Search
CPC ..... A62C 19/00; A62C 35/06
USPC ..... 169/58, 36, 68, 30
See application file for complete search history.

(56) References Cited

U.S. PATENT DOCUMENTS

| | | | | |
|---|---|---|---|---|
| 1,458,972 | A * | 6/1923 | Braude | 169/36 |
| 1,565,036 | A * | 12/1925 | Tank | 169/36 |
| 4,285,403 | A * | 8/1981 | Poland | 169/28 |
| 6,012,531 | A * | 1/2000 | Ryan | 169/36 |
| 6,796,382 | B2 * | 9/2004 | Kaimart | 169/43 |
| 7,090,029 | B2 * | 8/2006 | Cleary et al. | 169/53 |

* cited by examiner

*Primary Examiner* — Davis Hwu
(74) *Attorney, Agent, or Firm* — Barlow, Josephs & Holmes, Ltd.

(57) ABSTRACT

An article and method for spreading a substance about a surface is disclosed. The article includes a hollow, frangible shell having an opening. The shell is filled with a substance and a plug closes. A user throws the article at the surface where the substance is desired to be spread. Upon impact, the shell shatters scattering the substance.

3 Claims, 6 Drawing Sheets

ARTICLE AND METHOD FOR SPREADING A SUBSTANCE ABOUT A SURFACE

CROSS-REFERENCE TO RELATED APPLICATION

This patent document claims priority to earlier filed U.S. Provisional Patent Application Ser. No. 61/432,618, filed on Jan. 14, 2011, the entire contents of which are incorporated herein by reference.

BACKGROUND OF THE INVENTION

1. Field of the Invention

This patent document relates generally to an article and a method of spreading a substance about a surface, such as spreading sand over an icy walk and driveway to prevent slips and falls.

2. Background of the Related Art

Spreading a substance over a surface can be time consuming and arduous work. For instance, spreading salt and sand over an icy walk or driveway can be difficult because the user must often lift a heavy bag or pail of the salt or sand and carry it around and pour the salt and sand out on to where it is desired. This method, though, can result in injury to the user because not only is he or she carrying a heavy bag which can strain the shoulders and back, but they are also walking on an often slippery surface, which could result in the user slipping and falling.

To minimize the risk of slipping and falling, the user may resort to using a tool, such as a shovel, to spread the substance instead of carrying a heavy bag. However, the user often must still walk on the slippery surface to spread the substance. Also flinging sand and salt with a shovel can still cause injury to the user's back. Accordingly, there is a need for a method and device for spreading a substance on a surface that minimizes the risks to the user by eliminating the need to carry a heavy bag or pail of the substance and minimizing the user's need to traverse unnecessarily the surface that the user intends to spread the substance.

SUMMARY OF THE INVENTION

This invention solves the problems of the prior art by providing a hollow frangible shell filled with a substance that is desired to be spread. The user hurls the article at a point on the surface where the substance is desired. Upon impact, the shell shatters and the substance is released over the surface around the point of impact.

BRIEF DESCRIPTION OF THE DRAWINGS

These and other features, aspects, and advantages of the invention will become better understood with reference to the following description, appended claims, and accompanying drawings where:

DESCRIPTION OF THE PREFERRED EMBODIMENT

Figure 1:
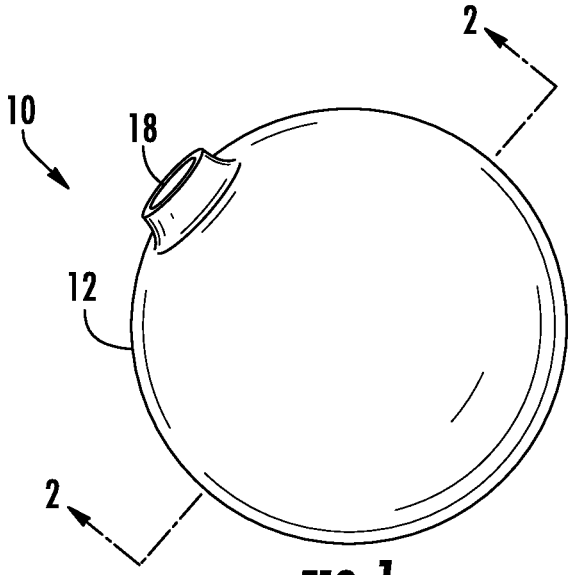
FIG. 1 is a perspective view of the article.
Figure 2:
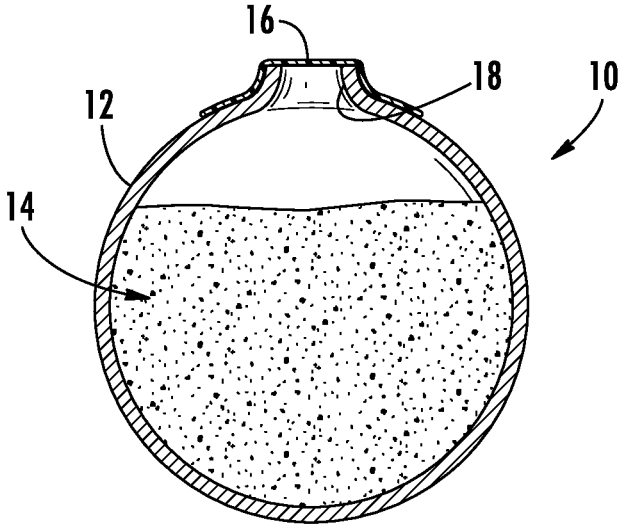
FIG. 2 is a cross-section view through line 2-2 of FIG. 1.
Figure 3:
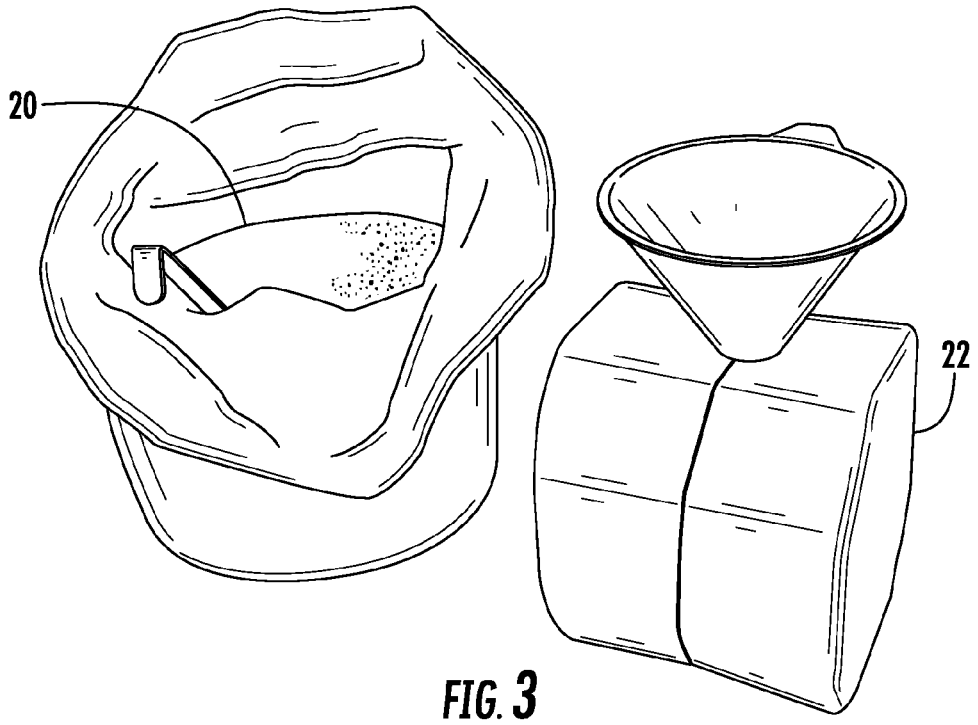
FIG. 3 is a perspective view of liquid clay being poured into a mold to form the shell.
Figure 4:
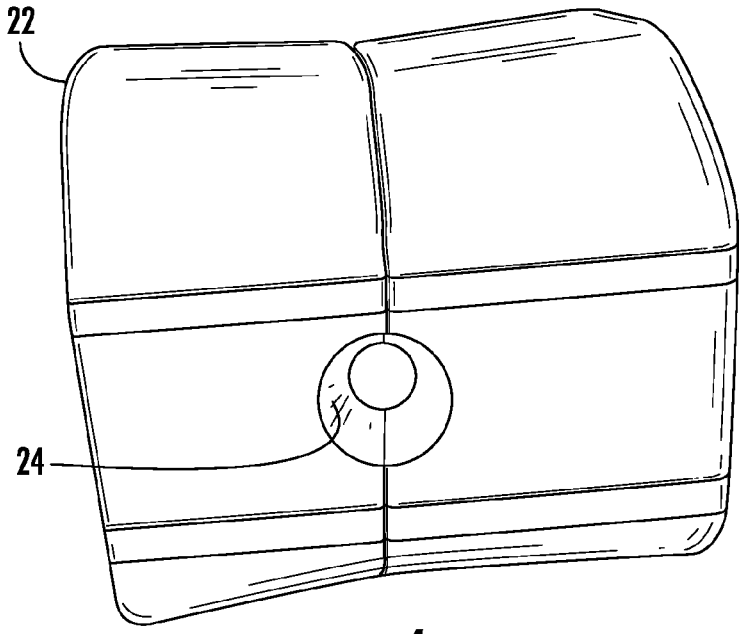
FIG. 4 is a perspective view showing the mold being progressively rotated to coat the mold cavity entirely with liquid clay.
Figure 5:
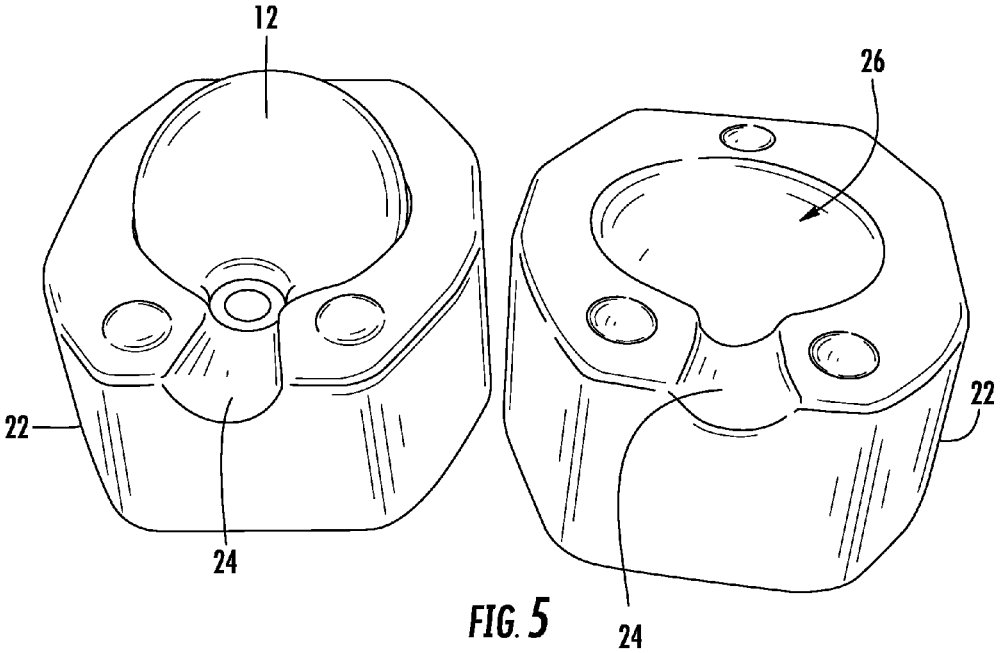
FIG. 5 is a perspective view of the mold opened with the fully set clay shell therein.
Figure 6:
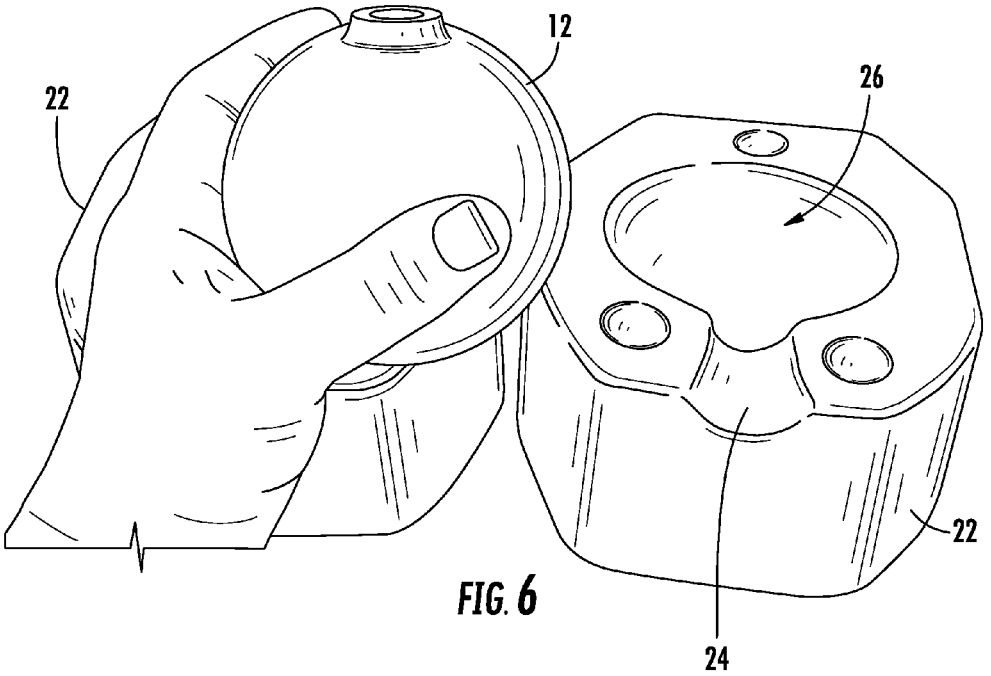
FIG. 6 is a perspective view of the fully set clay shell removed from the mold.
Figure 7:
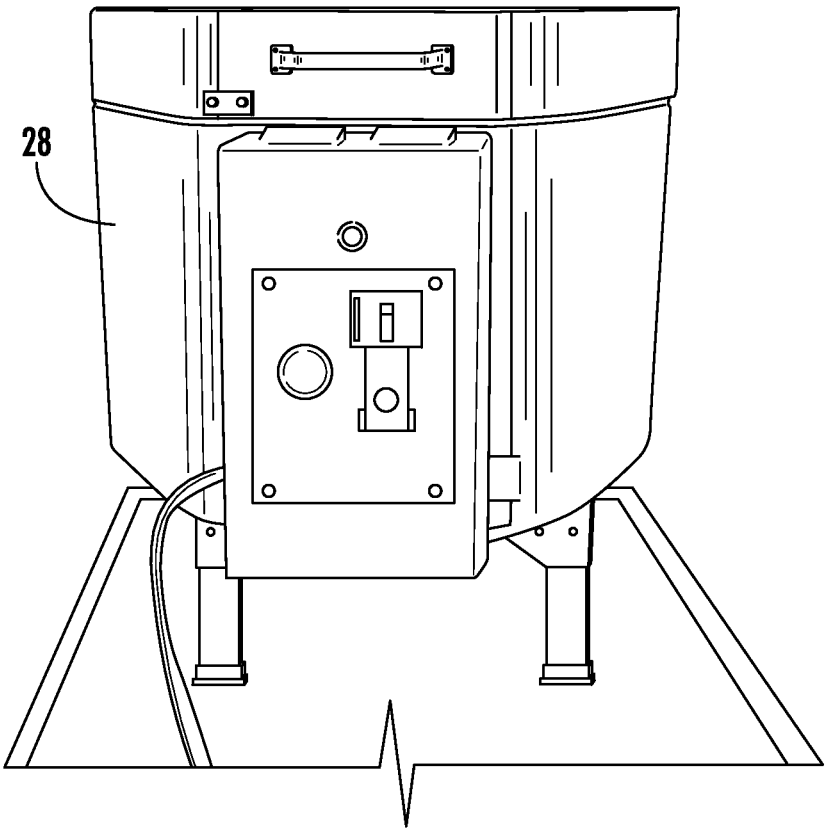
FIG. 7 is a perspective view of a kiln with a clay shell being fired therein.
Figure 8:
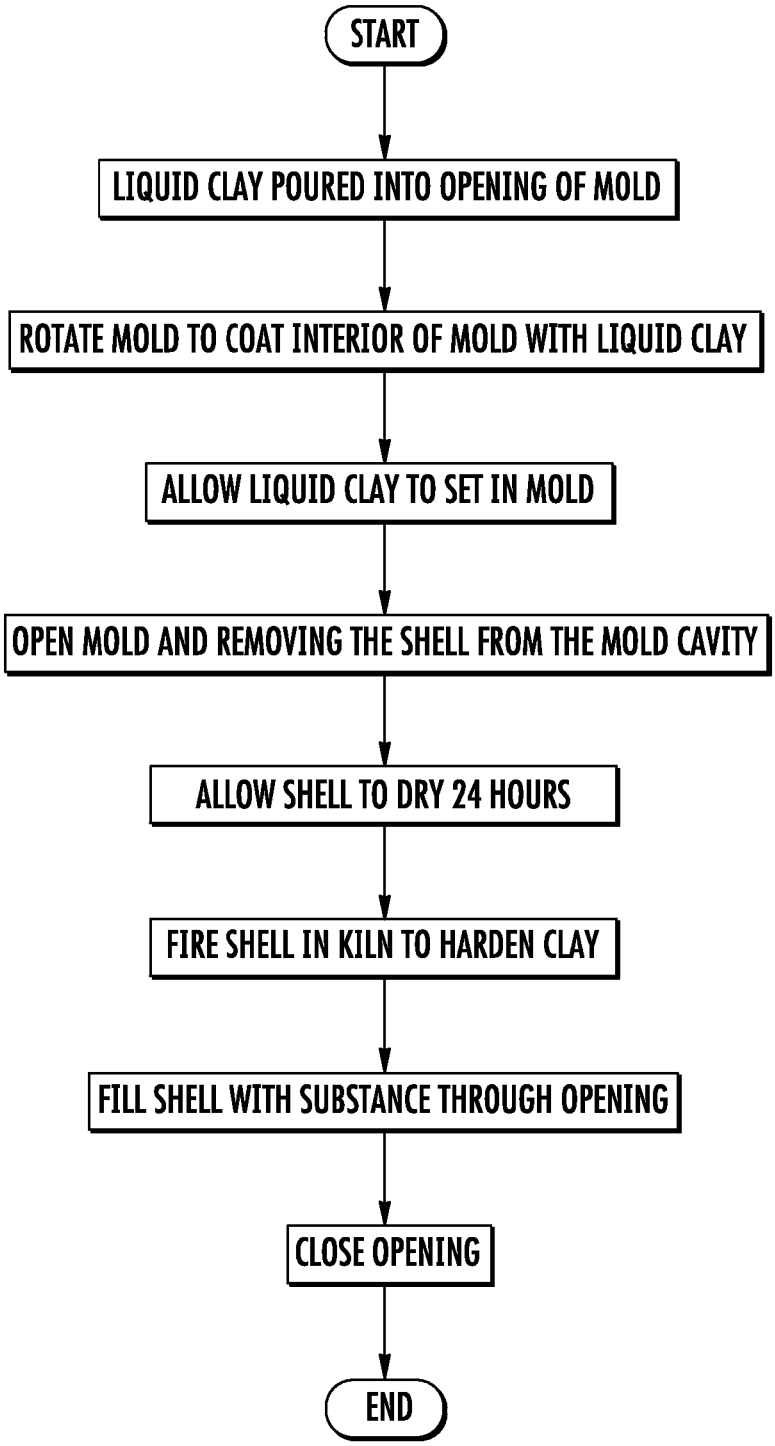
FIG. 8 is a flow diagram of the steps in building an article described herein.

Referring now to FIGS. 1 and 2, the article for spreading a substance about a surface is shown generally at 10. The article includes a hollow and frangible shell 12 filled with a substance 14 that is desired to be spread about a surface. A plug 16 seals an opening 18 on the shell 12.

The shell 12 may be formed from clay. However, other materials may be used provided that the material can shatter or break apart when thrown. Clay is a suitable substance because the clay is biodegradable and will wash away in the rain. Although not a specific requirement or limitation of the invention, materials used to form the shell 12 should also be selected with the biodegradability of the material in mind.

Referring now to FIGS. 3-8, the method of forming the shell 12 from clay is shown generally. The liquid clay 20 may be poured into an opening 24 of a mold 22 with an interior cavity 26 formed in the shape of the shell 12. The mold 22 is then rotated to coat the interior of the mold cavity 26 with the liquid clay 20. The liquid clay 20 is then allowed to set. The opening 24 into the mold cavity 26 also forms the opening 18 into the shell 12 when the clay is fully set. The mold 22 is opened and the shell 12 is removed from the mold cavity 26. The shell 12 may then be fired in a kiln 28 to harden the clay and make it brittle. The shell 12 is then ready to be filled with the desired substance 14.

The substance 14 that is desired to be spread about a surface is contained inside the hollow shell 12. For instance, an abrasive, such as sand may be used. Other ice melts may also be used such as, but not limited to, sodium chloride (rock salt), calcium chloride, potassium chloride, urea, magnesium chloride, sodium acetate, calcium magnesium acetate, ammonium nitrate, ammonium sulfate, and various blends of the above, with and without abrasives (such as sand, etc.).

The opening 18 on the shell 12 is then plugged to prevent the substance 14 from spilling out of the shell 12. In one embodiment, a cellulous plug 16 is used to close the opening into the shell 12. The advantage of using a cellulous plug 16 is that the cellulous plug 16 will dissolve in the rain.

Figure 9:
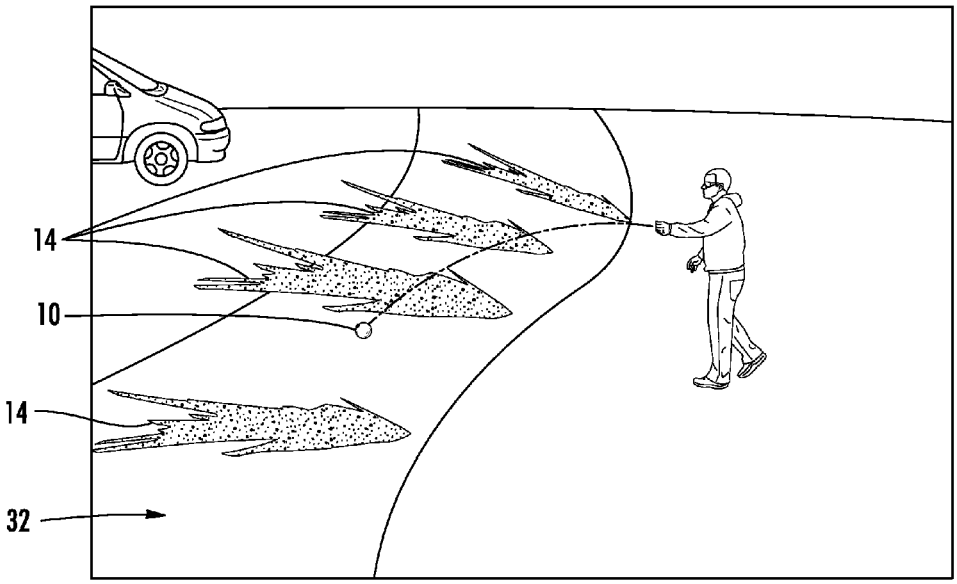
FIG. 9 is perspective view of multiple articles shown shattered on a driveway with the substance spread over the points of impact.

Referring now to FIG. 9, a person uses the article 10 by throwing the article 10 at the surface where the substance is desired to be spread. In the case of an icy driveway or walk, the article 10 filled with sand and abrasives and/or ice melt material can be thrown at the icy driveway 32. The shell 12 shatters on the hard surface and the substance 14 in the shell 12 is spread about the point of impact on the surface. A user may throw multiple articles 10 to achieve the desired coverage of the surface with the substance 14. If large fragments of shells 12 persist after the article is thrown, the person can step on the large fragments and crush them into smaller particles.

Therefore, it can be seen that the invention provides a unique solution to the problem of providing an article and method to spread a substance, such as sand and ice melt, over a surface, such as an icy walk or driveway.

It would be appreciated by those skilled in the art that various changes and modifications can be made to the illustrated embodiments without departing from the spirit of the invention. All such modifications and changes are intended to be within the scope of the invention.

I claim:

1. An article for spreading a substance about a surface to increase traction thereon, comprising:

a hollow, frangible, spherical shell having an opening, the shell configured and arranged to shatter into irregular fragments on a forceful impact;

a substance inside the shell, the substance selected from the group consisting essentially of sand, ice melt and a mixture of sand and ice melt; and a plug closing the opening in the shell.

2. The article of claim 1, wherein the shell is formed from clay.

3. The article of claim 1, wherein the plug is formed from cellulous.

* * * * *